US005433552A

United States Patent [19]

Thyu

[11] Patent Number: 5,433,552

[45] Date of Patent: Jul. 18, 1995

[54] SEAT PILLAR LOCK DEVICE FOR EXERCISING MACHINES

[76] Inventor: Chorng-Thyong Thyu, No. 167, Feng Shih Road, Feng Yuan City, Taichung County, Taiwan

[21] Appl. No.: 202,455

[22] Filed: Feb. 28, 1994

[51] Int. Cl.[6] ..... A47C 3/34

[52] U.S. Cl. ..... 403/378; 403/322; 403/109; 297/344.18

[58] Field of Search ..... 403/109, 322, 321, 377, 403/378; 70/233, 181, 182; 248/408, 188.5; 482/908, 62; 292/163, 164, 175, 338, 339; 297/344.12, 344.18

[56] References Cited

U.S. PATENT DOCUMENTS

| | | | |
|---|---|---|---|
| 617,500 | 1/1899 | Ehling | 403/109 X |
| 2,568,988 | 9/1951 | Childs | 297/344.18 X |
| 3,255,619 | 6/1966 | Haglund et al. | 70/182 |
| 3,554,585 | 1/1971 | Sorenson | 248/408 X |
| 3,604,734 | 9/1971 | Friedman | 403/109 X |
| 4,884,842 | 12/1989 | Finkelstein | 297/344.18 X |

FOREIGN PATENT DOCUMENTS

| | | | |
|---|---|---|---|
| 2837558 | 3/1980 | Germany | 297/344.12 |

*Primary Examiner*—Anthony Knight
*Attorney, Agent, or Firm*—Beveridge, DeGrandi, Weilacher & Young

[57] ABSTRACT

A seat pillar lock device includes a seat tube having a nut, a bushing fitted into the seat tube, a seat pillar inserted into the bushing, and a lock knob fastened to the nut on the seat tube to lock the seat pillar in any of a series of elevations, and a stepped packing ring received in an expanded bottom hole on the nut and controlled by the lock knob to tighten up the seat pillar in position, the lock knob consists of a knob, a nut fixed inside the knob, a screw member having one end fastened to the knob through a toothed joint and an opposite end terminating in a threaded portion threaded into the nut on the seat tube, a latch having a screw rod at one end inserted through a longitudinal through hole on the screw member and fastened to the nut inside the knob and a latch head at an opposite end inserted through the nut on the seat tube and any of a series of vertically spaced lock holes on the seat pillar, and a tension spring stopped by the latch head inside the screw member.

1 Claim, 4 Drawing Sheets

SEAT PILLAR LOCK DEVICE FOR EXERCISING MACHINES

BACKGROUND OF THE INVENTION

The present invention relates to a seat pillar lock device for an exercising machine which allows the seat pillar to be conveniently adjusted to any of a series of elevations.

A variety of exercising machines have been disclosed, and have appeared on the market. An exercising machine may have a seat for the user to sit when the user is operating the exercising machine. In order to fit different users, the seat of an exercising machine is commonly made adjustable so that it can be adjusted to the desired elevation according to individual's requirement. FIGS. 1 and 2 show a seat pillar lock device according to the prior art, which is generally comprised of a nut 3' fastened to the seat tube 2', a steel ball 4' and a spring 5' received in the nut 3', a socket 6' fastened to the nut 3' by a screw joint, a knob 8', and a screw rod 7' threaded into the inner thread on the socket 6' and having one end supported on the spring 5' and stopped against the steel ball 4' and an opposite end extended out of the socket 6' and connected to the knob 8' by a screw 9'. When the knob 8' is turned in one direction to turn the screw rod 7' inwards, the steel ball 4' is squeezed into either of a series of vertically spaced recessed hole on the seat pillar 1' to lock the seat pillar 1' in position. This structure of seat pillar lock device is complicated to manufacture because the screw rod and the knob must be processed with a respective hole for fastening, and the front end of the screw rod 7' must be properly made to fit the steel ball 4'. Furthermore, simply engaging the steel ball 4' into either recessed hole on the seat pillar 1' cannot firmly stop the seat pillar 1' from being oscillated, and the seat pillar 1' may slip in the seat tube 2' which can cause injury to a user.

SUMMARY OF THE INVENTION

The present invention has been accomplished to provide a seat pillar lock device which eliminates the aforesaid drawbacks.

According to the preferred embodiment of the present invention, the seat pillar lock device comprises a seat tube having a nut, a bushing fitted into the seat tube, a seat pillar inserted into the bushing, and a lock knob fastened to the nut on the seat tube to lock the seat pillar in any of a series of elevations, and a stepped packing ring received in an expanded bottom hole on the nut and controlled by the lock knob to tighten up the seat pillar in position, wherein the lock knob consists of a knob, a nut fixed inside the knob, a screw member having one end fastened to the knob through a toothed joint and an opposite end terminating in a threaded portion threaded into the nut on the seat tube, a latch having a screw rod at one end inserted through a longitudinal through hole on the screw member and fastened to the nut inside the knob and a latch head at an opposite end inserted through the nut on the seat tube and any of a series of vertically spaced lock holes on the seat pillar, and a tension spring stopped by the latch head inside the screw member. Because the seat pillar is locked in position by the latch and the stepped packing ring, it does not oscillate during the operation of the exercising machine. Furthermore, the bushing is made of a flexible material which prevents direct friction between the seat tube and the seat pillar and allows the seat pillar to be firmly locked in position.

DETAILED DESCRIPTION OF THE PREFERRED EMBODIMENT

Figure 1:
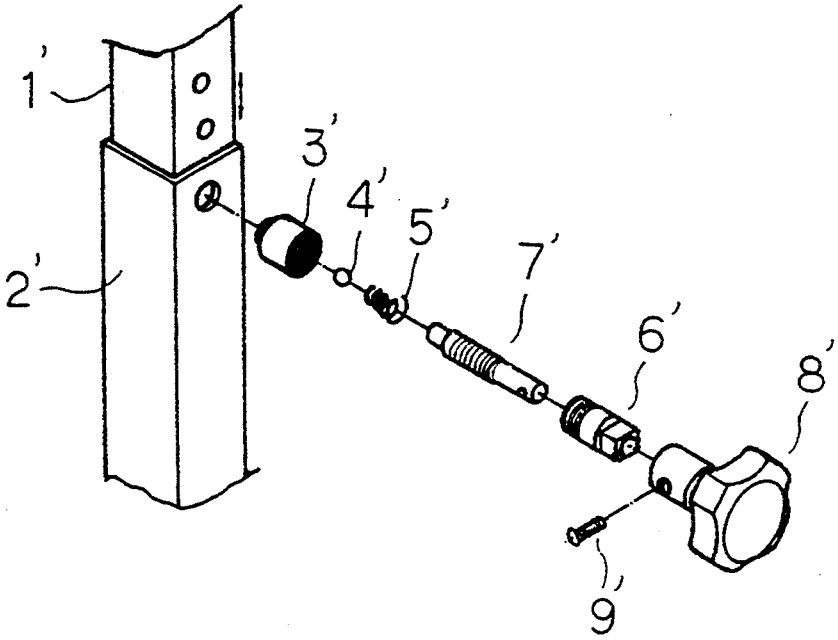
FIG. 1 PRIOR ART
FIG. 1 is an exploded view of a seat pillar lock device according to the prior art.
Figure 2:
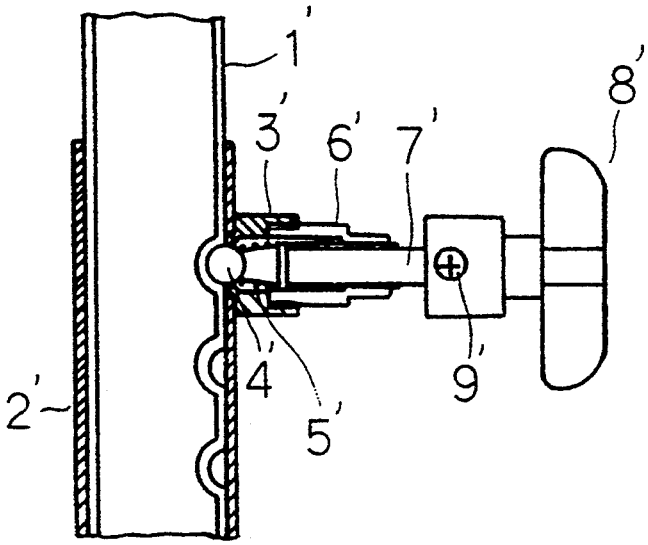
FIG. 2 PRIOR ART
FIG. 2 is a sectional assembly view of the seat pillar lock device shown in FIG. 1.
Figure 3:
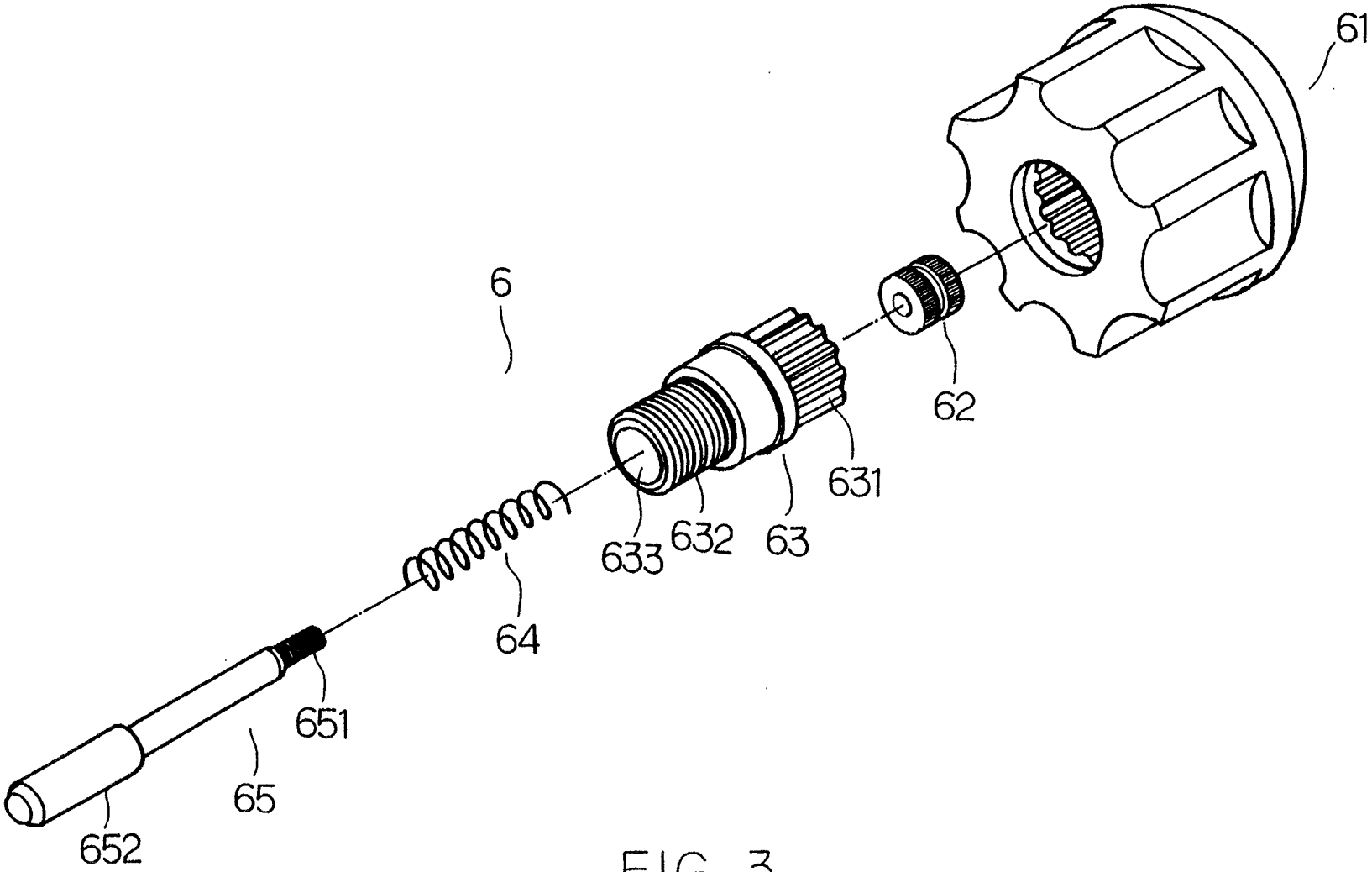
FIG. 3 is an exploded view of a lock knob according to the present invention.
Figure 4:
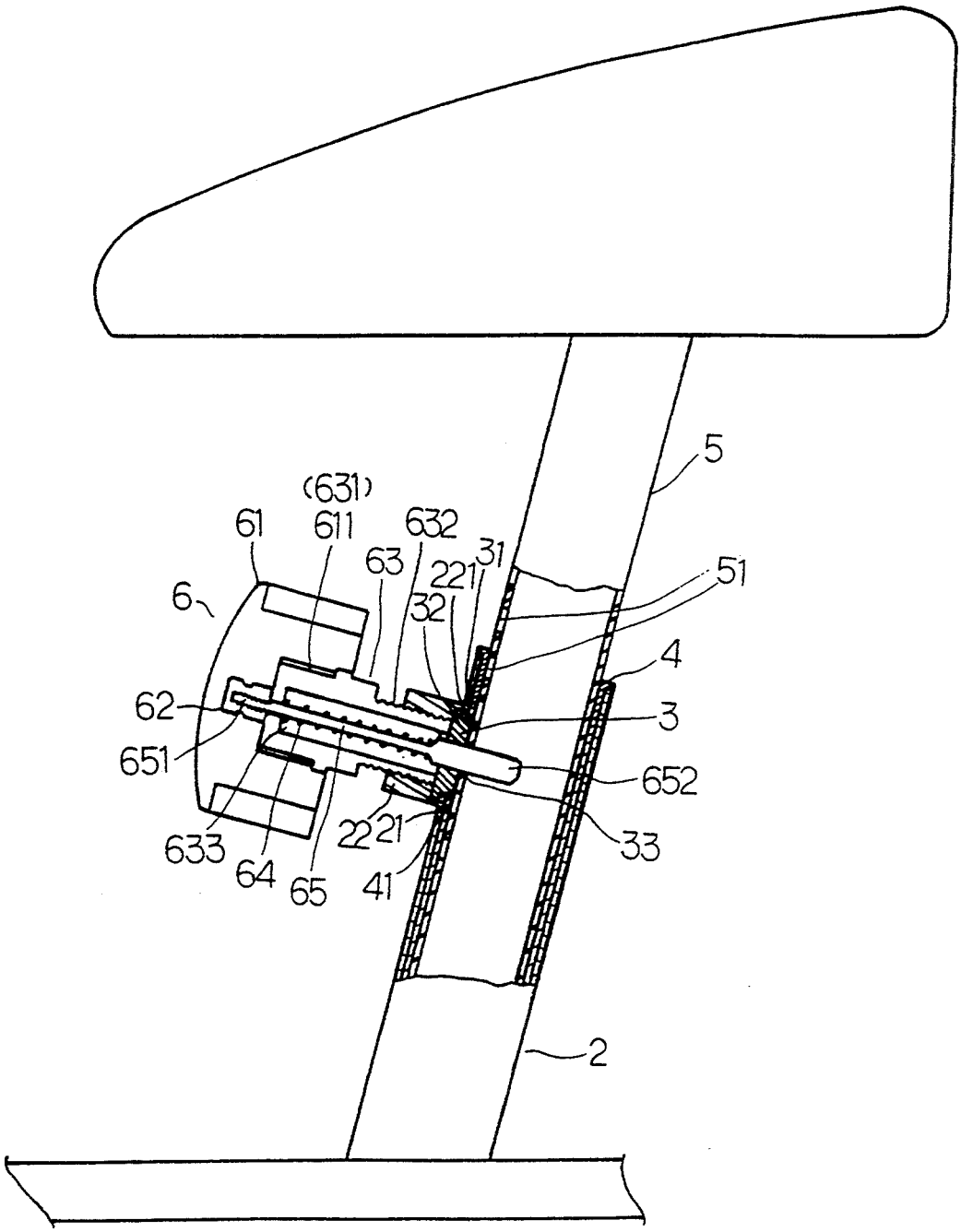
FIG. 4 is a sectional view showing the lock knob of FIG. 3 installed and locked.

Referring to FIGS. 3 and 4, a seat tube lock device in accordance with the present invention is generally comprised of a seat tube 2 raised from the base of an exercising machine, a seat pillar 5 inserted into the seat tube 2 to support a seat, a stepped packing ring 3, a bushing 4, and a lock knob 6.

The seat tube 2 comprises a side through hole 21 through the wall at one side, a nut 22 welded to the outside wall around the side through hole 21. The nut 22 has an expanded bottom hole 221 attached to the outside wall of the seat tube 2 around the side through hole 21.

The bushing 4 is made of a flexible material fitted into the inside wall of the seat tube 2, having a side through hole 41 aligned with the side through hole 21 on the seat tube 2.

The stepped packing ring 3 comprises a lower packing ring section 31 fitted into the side through hole 21 on the seat tube 2 and the side through hole 41 on the bushing 4, an upper packing ring section '=received in the expanded bottom hole 221 of the nut 22, and a center through hole 33 through the lower and upper packing ring sections.

The seat pillar 5 is inserted into the bushing 4, having a series of vertically spaced circular through holes 51.

The lock knob 6 comprises a rotary knob 61, a nut 62, a screw member 63, a tension spring 64, and a latch 65. The nut 62 is fixed inside the rotary knob 61. The rotary knob 61 comprises a unitary internal gear 611. The screw member 63 comprises a toothed portion 631 at one end meshed with the internal gear 611 of the rotary knob 61, a threaded portion 632 at an opposite end threaded into the nut 22 on the seat tube 2, and a longitudinal center through hole 633 through the longitudinal axis thereof. The latch 65 comprises a screw rod 651 at one end inserted through the longitudinal center through hole 633 on the screw member 63 and then threaded into the nut 62 inside the rotary knob 61, and a latch head 652 at an opposite end inserted into the center through hole 33 of the stepped packing ring 3. The tension spring 64 is mounted around the latch 65 and stopped inside the longitudinal center through hole 633 of the screw member 63 by the latch head 652 of the latch 65.

Referring to FIG. 4 again, when the threaded portion 632 of the screw member 63 is threaded into the nut 22 on the seat tube 2, the latch head 652 is inserted into one circular through hole 51 on the seat pillar 5, and then the rotary knob 61 is turned tight causing the lower packing ring section 31 of the stepped packing ring 3 engaged into the side through hole 41 on the bushing 4 and tightly stopped against the seat pillar 5, and therefore the seat pillar 5 is locked in position.

Figure 5:
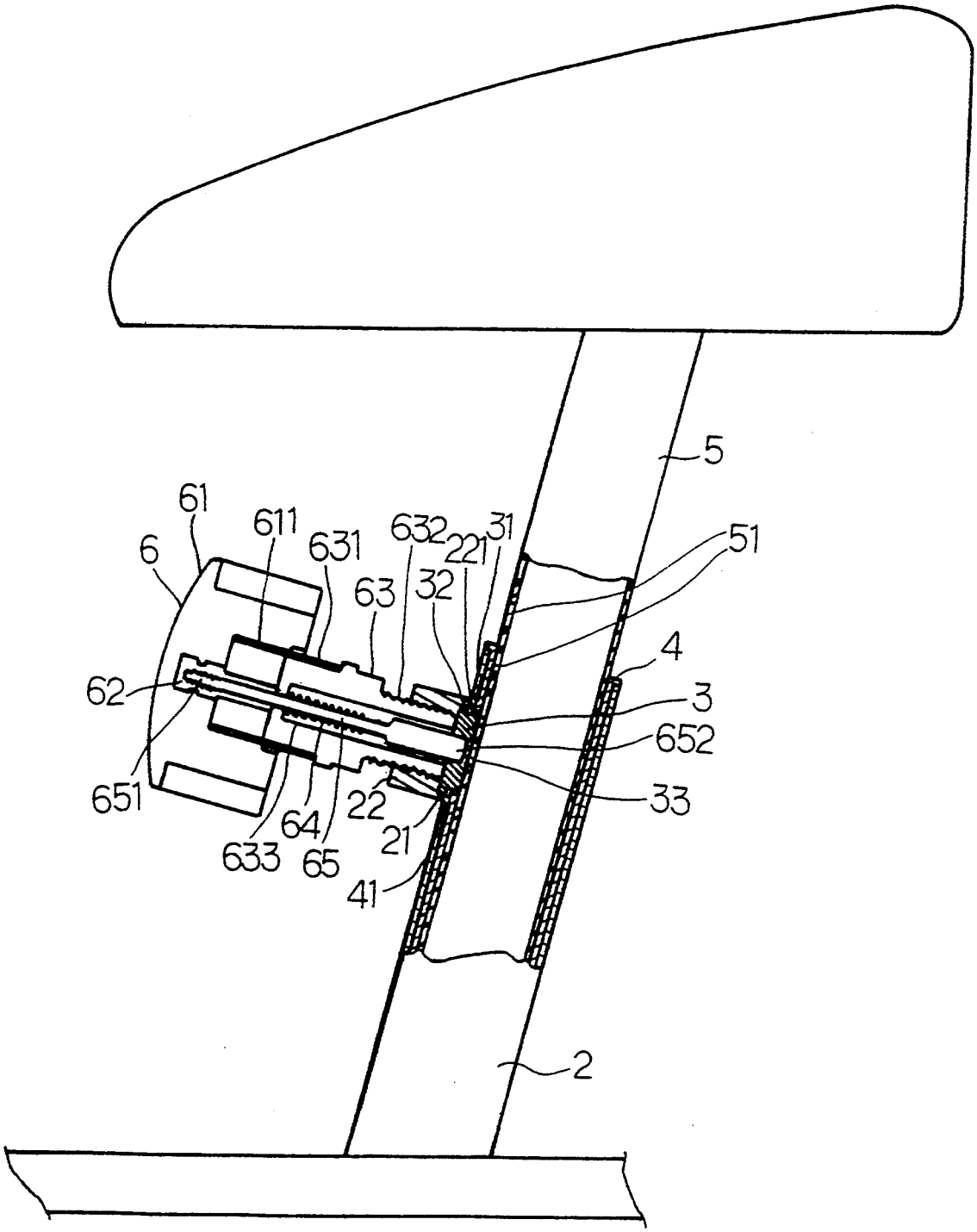
FIG. 5 is similar to FIG. 4 but showing the lock knob released.

Referring to FIG. 5, by turning the rotary knob in the reversed direction to release the latch head 652 and the stepped packing ring 3 from the seat pillar 5, the seat pillar 5 can then be moved vertically in the bushing 4 to adjust the elevation of the seat.

What is claimed is:

1. A seat pillar lock device comprising:

a seat tube having a first nut welded to the outside wall thereof around a side through hole thereof, said first nut having an expanded bottom hole;

a bushing fitted into said seat tube and having a side through hole aligned with the side through hole on said seat tube;

a stepped packing ring retained to said seat tube by said first nut, said stepped packing ring comprising a lower packing ring section fitted into the side through hole on said seat tube and the side through hole on said bushing, an upper packing ring section received inside the expanded bottom hole on said first nut, and a center through hole through said lower and upper packing ring sections;

a seat pillar inserted into said bushing and having a series of vertically spaced circular through holes for positioning said seat pillar within said seat tube;

a lock knob fastened to said seat tube to lock said seat pillar in any of a series of elevations, said lock knob comprising a rotary knob having a second nut fixed on the inside at the bottom of a unitary internal gear thereof, a screw member having a toothed portion at one end meshed with the internal gear of said rotary knob and a threaded portion at an opposite end threaded into said first nut and a longitudinal center through hole, a latch having a screw rod at one end inserted through the longitudinal center through hole on said screw member and then threaded into said second nut inside said rotary knob and a latch head at an opposite end inserted through the center through hole of said stepped packing ring into either circular through hole on said seat pillar to lock said seat pillar in place, a tension spring mounted around said latch and stopped inside the longitudinal center through hole of said screw member by said latch head of said latch.

* * * * *